US006558025B2

(12) United States Patent
Bellig et al.

(10) Patent No.: US 6,558,025 B2
(45) Date of Patent: May 6, 2003

(54) METHOD AND APPARATUS FOR MOUNTING A LAMP

(75) Inventors: David Bellig, Mankato, MN (US); Peter Skadahl, Mankato, MN (US); Steve Stenzel, Good Thunder, MN (US); Randy Wise, New Ulm, MN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,998

(22) Filed: Jul. 5, 2001

(65) Prior Publication Data

US 2003/0007361 A1 Jan. 9, 2003

(51) Int. Cl.[7] ..... F21S 13/02

(52) U.S. Cl. ..... 362/432; 362/249; 362/396; 362/217; 362/225; 362/370

(58) Field of Search ..... 362/249, 396, 362/217, 225, 370, 432

(56) References Cited

U.S. PATENT DOCUMENTS 1,222,458 A * 4/1917 Peterson
2,656,454 A * 10/1953 Yacyshyn
2,687,516 A * 8/1954 Schneiderman
3,008,135 A * 11/1961 Willcox
5,039,904 A 8/1991 Kosmatka et al.
5,181,774 A * 1/1993 Lane ..... 362/72
5,195,817 A * 3/1993 Deccio ..... 362/72
5,757,112 A * 5/1998 Van Dulmen ..... 313/113
6,147,880 A 11/2000 Fuhr et al.

* cited by examiner

*Primary Examiner*—Sandra O'Shea
*Assistant Examiner*—Jacob Y. Choi
(74) *Attorney, Agent, or Firm*—Karl A. Vick, Esq.; Armstrong Teasdale LLP

(57) ABSTRACT

A method for restricting removal of a electrical lamp in a mounting bracket is provided. The mounting bracket including a first opening, a second opening and a mounting face. The method includes providing an electrical lamp including a lamp length and a plurality of lamp diameters and inserting the electrical lamp at least partly though the mounting bracket. The method further includes positioning the mounting bracket first opening adjacent a first surface such that the first surface is in close proximity to the first opening and securing the mounting face to a structure.

15 Claims, 1 Drawing Sheet

METHOD AND APPARATUS FOR MOUNTING A LAMP

BACKGROUND OF INVENTION

This invention relates generally to lamps, and more particularly to brackets designed for mounting lamp holders.

Electrical lamps are used in many applications to provide lighting. At least some known electrical lamps are long-lasting lamps which may provide more sophisticated features than merely supplying incandescent light. For example, lamps can be differentiated by many features, including, but not limited to, lighting type, lumen rating, current rating, color, daylight-sensing, motion-sensing, and frequency range, including infrared, ultraviolet, microwave, and other portions of the electromagnetic spectrum. Despite an increased expense for such lamps, demand for such lamps has increased. Unfortunately, a risk of theft of such lamps has also increased.

SUMMARY OF INVENTION

In one aspect, a method for mounting an electrical lamp using a mounting bracket is provided. The mounting bracket includes a first opening, a second opening and a mounting face. The method includes the steps of inserting the electrical lamp at least partially though the mounting bracket, positioning the mounting bracket first opening adjacent a first surface such that the first surface is in close proximity to the first opening, and securing the mounting face to a structure.

In another aspect, a mounting bracket for an electrical lamp includes a mounting face and a first wall that extends from the mounting face and defines a first opening. A second wall also extends from the mounting face and defines a second opening. A diameter of the second opening is smaller than a diameter of the first opening.

In another aspect, a lamp assembly includes an electric lamp and a mounting bracket. The electric lamp has a first end, a second end, and a length extending therebetween. The lamp also includes at least a first outer diameter and at least a second outer diameter, each first outer diameter being smaller than each second outer diameter. The mounting bracket includes a mounting face, a first wall, and a second wall. The first wall extends from the mounting face and defines a first opening having a first opening diameter. The second wall extends from the mounting face and defines a second opening having a second opening diameter. The second opening diameter is smaller than the lamp second outer diameter. The electric lamp extends at least partly through the second opening such that the lamp second outer diameter is adjacent the first wall.

In a further aspect, a lamp assembly secured to an enclosure surface. The lamp assembly includes an electric lamp and a mounting bracket. The electric lamp has a first end, a second end, a length extending therebetween, at least one lamp first outer diameter, and at least one lamp second outer diameter, each first outer diameter being smaller than each second outer diameter. The mounting bracket includes a mounting face, a first wall, and a second wall. The mounting face includes a plurality of openings for receiving fasteners therethrough. The first wall extends from the mounting face and defines a first opening having a first opening diameter. The second wall extends from the mounting face and defines a second opening that is concentrically aligned with the first opening. The second opening has a second diameter that is smaller than the first opening diameter, and is smaller than at least one lamp second outer diameter. The first wall and the second wall are spaced apart a distance that is less than about three-quarters the lamp length and are substantially parallel. The electric lamp extends at least partly through the second opening, with the lamp second outer diameter adjacent the first wall.

The first wall is less than about three-quarters the lamp length from a first surface. The mounting face is secured to a structure.

DETAILED DESCRIPTION

Figure 1:
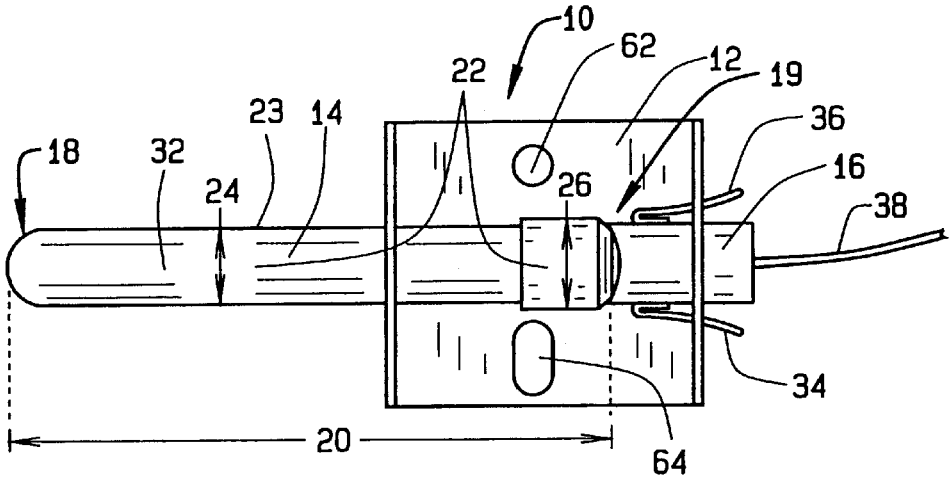
FIG. 1 is a plan view of a lamp assembly including a mounting bracket.

FIG. 1 is a plan view of a lamp assembly 10. Lamp assembly 10 includes a mounting bracket 12, an electric lamp 14, and a lamp holder 16. Electric lamp 14 and lamp holder 16 are retained within mounting bracket 12.

Electric lamp 14 has first end 18, a second end 19, a length 20 extending therebetween, and a plurality of outer lamp diameters 22 measured with respect to an outer surface 23 of lamp 14. More specifically, in the exemplary embodiment, electric lamp 14 includes a lamp first diameter 24, and a lamp second diameter 26 that is larger than lamp first diameter 24. In another embodiment, electric lamp 14 includes a conical portion (not shown) with associated plurality of lamp diameters 22. Electric lamp 14 includes a translucent or transparent outer portion 32, such that lamp 14 radiates energy when properly energized. In the exemplary embodiment, electric lamp 14 operates in the visible light range. In another embodiment, electric lamp 14 operates using infrared, ultraviolet, microwave, or other portions of the electromagnetic spectrum.

Lamp holder 16 is attached to electric lamp 14 and to mounting bracket 12. In the exemplary embodiment, lamp holder 16 receives a portion of electric lamp 14 therein, and is attached to mounting bracket 12 by a pair of spring arms 34 and 36. In one embodiment, lamp holder 16 also provides electrical connections (not shown) for electric lamp 14 and a wire 38 for supplying electrical power. In another embodiment, lamp holder 16 may be attached to mounting bracket 12 by a bayonet or threaded connection (not shown).

Figure 2:
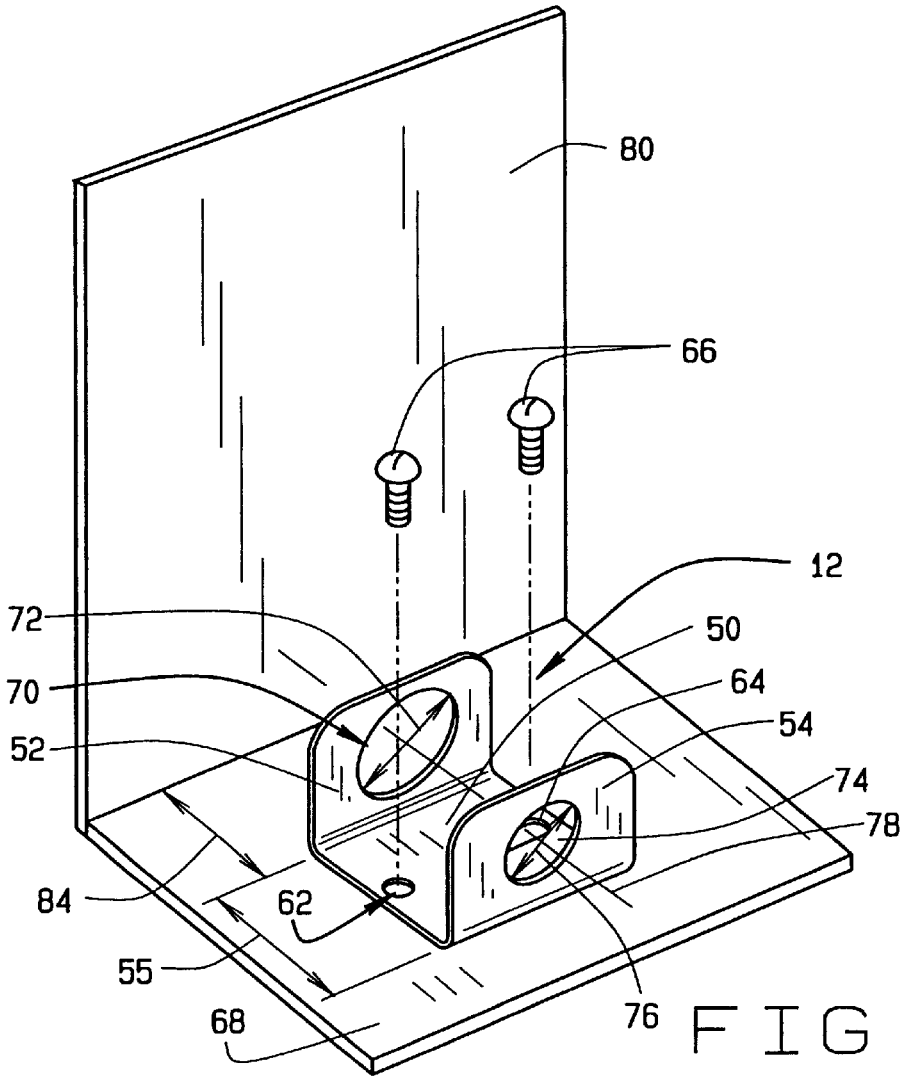
FIG. 2 is a perspective view of the mounting bracket shown in FIG. 1.

FIG. 2 is a perspective view of mounting bracket 12 (also shown in FIG. 1). Mounting bracket 12 includes a mounting face 50, a first wall 52, and a second wall 54. Both first wall 52 and second wall 54 extend from mounting face 50. First wall 52 and second wall 54 are spaced apart a distance 55 and are substantially parallel. In one embodiment, mounting bracket 12 is generally U-shaped in cross-section and distance 55 is about three-quarters lamp length 20.

Mounting face 50 includes at least one opening 60. In one embodiment, openings 60 include a circular opening 62 and a slot 64 for receiving threaded fasteners 66. In another embodiment a single slot 64, extending substantially across mounting face 50 is used. Openings 60 facilitate removeably coupling mounting face 50 to a structure 68.

First wall 52 defines a first opening 70 having a diameter 72. First opening diameter 72 is larger than a largest lamp outer diameter 22, and as such, is sized to receive electric lamp 14 therein, such that lamp 14 extends through first opening 70.

Second wall 54 defines a second opening 74 having a second opening diameter 76. Second opening diameter 76 is smaller than first opening diameter 72. Second opening 74 is concentrically aligned with respect to first opening 70, having an axis of symmetry 78. Second opening 74 is sized to receive lamp first end 18. Second opening diameter 76 is larger than lamp first diameter 24, but is smaller than lamp outer diameter 22. In the exemplary embodiment, second opening diameter 76 is smaller than lamp second diameter 26 such that lamp second end 19 is prevented from entering second opening 74.

In use, the desired electric lamp 14 and lamp holder 16 are selected. Electric lamp 14 is mated to lamp holder 16, and lamp first end 18 is inserted first through first opening 70. Electric lamp 14 is then inserted into second opening 74. Electric lamp 14 extends partly through second opening 74. Lamp holder 16 engages mounting bracket 12 such that electric lamp 14 and lamp holder 16 are secured in mounting bracket 12. In the exemplary embodiment, electric lamp 14 is positioned such that lamp second end 19 is between first wall 52 and second wall 54. In another embodiment lamp second end 19 extends partly through first opening 70.

Mounting bracket 12 is then positioned adjacent a first surface 80. More specifically, first wall 52 is positioned at a mounting distance 84 from first surface 80. Mounting distance 84 is less than or equal to approximately three-quarters of lamp length 20. First wall 52 is proximate first surface 80 while second wall 54 is distal from first surface 80. Mounting face 50 is secured to structure 68 by fasteners 66 extending through openings 60.

While mounting bracket 12 is secured to structure 68, electric lamp 14 cannot be removed from mounting bracket 12. Lamp second diameter 26 cannot pass through second opening 74, thus preventing removal of intact electric lamp 14 through second opening 74. More specifically, electric lamp 14 cannot be removed through first opening 70 because first surface 80 blocks first opening 70 at mounting distance 84.

Removal of electric lamp 14 requires mounting bracket 12 be unsecured from structure 68. The necessity of unsecured mounting bracket 12 deters the speedy removal of electric lamp 14, thus deterring a theft of electric lamp 14. Lamp assembly 10 therefore reduces costly theft while providing for safe and reliable electrical lamp mounting.

While the invention has been described in terms of various specific embodiments, those skilled in the art will recognize that the invention can be practiced with modification within the spirit and scope of the claims.

What is claimed is:

1. A method for mounting an electrical lamp comprising:

providing a unitary mounting bracket including a first bracket projection, a second bracket projection, and a mounting face extending therebetween, wherein the first bracket projection includes a first opening defined entirely within the first bracket projection, and wherein a second opening is defined entirely within the second bracket projection;

connecting the electrical lamp to a lamp holder;

inserting the electrical lamp at least partly through the mounting bracket first and second openings, such that the mounting bracket first and second openings circumscribe a portion of the electric lamp;

engaging the lamp holder to the mounting bracket;

positioning the mounting bracket first opening adjacent a first surface such that the first surface is in close proximity to the first opening; and securing the mounting face to a structure.

2. A method in accordance with claim 1 wherein said step of inserting the electrical lamp comprises the steps of:

inserting the electrical lamp at least partly through the mounting bracket first opening; and inserting the electrical lamp at least partly through the mounting bracket second opening.

3. A method in accordance with claim 1 wherein said step of positioning the mounting bracket first opening further comprises the step of positioning the mounting bracket such that the mounting bracket first opening is a distance from the first surface that is less than about three-quarters of a length of the lamp.

4. A method in accordance with claim 3 wherein said step of positioning the mounting bracket first opening comprises the step of positioning the first opening at a distance from the first surface that facilitates preventing the electrical lamp from being removed from the mounting bracket.

5. A method in accordance with claim 1 wherein said step of securing the mounting face to a structure further comprises the step of fastening the mounting face to the structure with at least one fastener.

6. A lamp assembly comprising:

an electric lamp having a first end, a second end, a length extending therebetween, at least a first outer diameter and at least a second outer diameter, each said first outer diameter smaller than each said second outer diameter; and a mounting bracket comprising a mounting face, a first wall, and a second wall, said first wall extending from said mounting face and defining a first opening comprising a first opening diameter, said second wall extending from said mounting face and defining a second opening comprising a second opening diameter, said second opening diameter smaller than said lamp second outer diameter, said electric lamp extending at least partly through said second opening such that said lamp second outer diameter is adjacent said first wall.

7. A lamp assembly in accordance with claim 6 wherein said mounting bracket first wall and said mounting bracket second wall are spaced apart and substantially parallel.

8. A lamp assembly in accordance with claim 7 wherein said mounting bracket first wall and said mounting bracket second wall are spaced apart a distance less than about three-quarters said lamp length.

9. A lamp assembly in accordance with claim 6 wherein said mounting bracket first opening and said mounting bracket second opening are concentrically aligned.

10. A lamp assembly in accordance with claim 6 wherein said mounting face comprises at least one opening configured to receive a fastener therethrough.

11. A lamp assembly in accordance with claim 10 wherein said mounting face comprises a plurality of opening extending therethrough.

12. A lamp assembly in accordance with claim 11 wherein said mounting face openings comprise a plurality of slots for receiving fasteners therethrough.

13. A lamp assembly in accordance with claim 6 further comprising a lamp holder, said lamp holder attached to said lamp and received within said mounting bracket first opening.

14. A lamp assembly in accordance with claim 13 wherein said lamp holder configured to secure said electric lamp such that said lamp is substantially stationary relative to said mounting bracket.

15. A lamp assembly secured to a structure, said lamp assembly comprising:

an electric lamp having a first end, a second end, a length extending therebetween, at least one lamp first outer diameter, and at least one lamp second outer diameter each said lamp first outer diameter smaller than each said lamp second outer diameter; and a mounting bracket comprising a mounting face comprising a plurality of openings for receiving fasteners therethrough, a first wall extending from said mounting face and defining a first opening comprising a first opening diameter, and a second wall extending from said mounting face and defining a second opening concentrically aligned with said first opening, said second opening comprising a second opening diameter, said second opening diameter smaller than said first opening diameter, said second opening diameter smaller than each said lamp second outer diameter, said first wall and said second wall substantially parallel and spaced apart a distance less than about three-quarters said lamp length, said electric lamp extending at least partly through said second opening, said lamp second outer diameter adjacent said first wall, said first wall being less than about three-quarters said lamp length from a first surface, said mounting face secured to a structure.

* * * * *

UNITED STATES PATENT AND TRADEMARK OFFICE

CERTIFICATE OF CORRECTION

PATENT NO. : 6,558,025 B2
DATED : May 6, 2003
INVENTOR(S) : Bellig et al.

It is certified that error appears in the above-identified patent and that said Letters Patent is hereby corrected as shown below:

Column 4,
Line 51, delete “opening” and insert therefor -- openings --.

Signed and Sealed this

Twenty-second Day of July, 2003

JAMES E. ROGAN
*Director of the United States Patent and Trademark Office*